United States Patent [19]

Gallagher et al.

[11] 4,261,628

[45] Apr. 14, 1981

[54] MICROPHONE CONNECTOR

[75] Inventors: David Gallagher, Romeoville; Ronald Krolak, North Riverside, both of Ill.

[73] Assignee: Bunker Ramo Corporation, Oak Brook, Ill.

[21] Appl. No.: 34,880

[22] Filed: Apr. 30, 1979

[51] Int. Cl.[3] ..... H01R 4/66

[52] U.S. Cl. ..... 339/14 R; 339/91 R; 339/61 R

[58] Field of Search ..... 339/14 P, 14 R, 61 R, 339/91 R, 143 R, 186 R

[56] References Cited

U.S. PATENT DOCUMENTS

| | | | |
|---|---|---|---|
| 2,869,095 | 1/1959 | Arson | 339/61 R |
| 2,880,403 | 3/1959 | Maxwell | 339/14 R |
| 3,219,961 | 11/1965 | Bailey et al. | 339/14 R |
| 3,381,258 | 4/1968 | Becker, Jr. | 339/14 P |
| 3,721,939 | 3/1973 | Paugh | 339/91 R X |
| 3,885,849 | 5/1975 | Bailey et al. | 339/61 R |

FOREIGN PATENT DOCUMENTS

| | | |
|---|---|---|
| 693918 | 7/1953 | United Kingdom . |
| 1364170 | 8/1974 | United Kingdom . |

*Primary Examiner*—John McQuade
*Assistant Examiner*—DeWalden W. Jones
*Attorney, Agent, or Firm*—F. M. Arbuckle; T. J. Haller

[57] ABSTRACT

A cable connector having a plug assembly which may be reversibly mated to a receptacle assembly. A grounding clip is provided as part of a socket insert subassembly which projects outwardly of the plug assembly for reception and mounting in the receptacle assembly. The grounding clip in part functions to insure that the plug and receptacle assembly housings are in grounded electrical connection with one another and further functions to electrically connect a ground wire means associated with the plug assembly to the housing thereof. The clip also includes a spring element which biases a latch for the connector into a locked disposition.

20 Claims, 13 Drawing Figures

FIG. 1
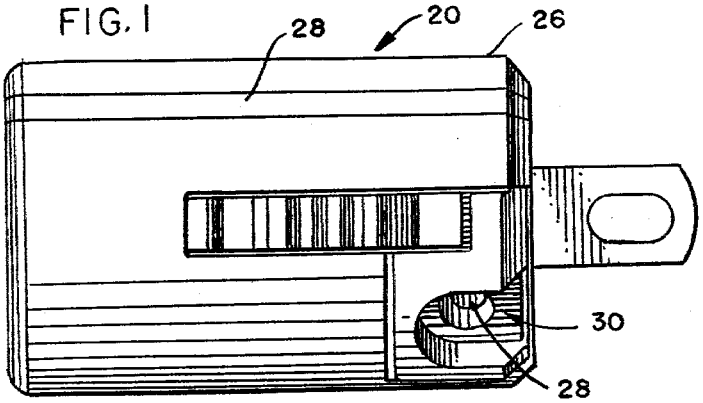
FIG. 2
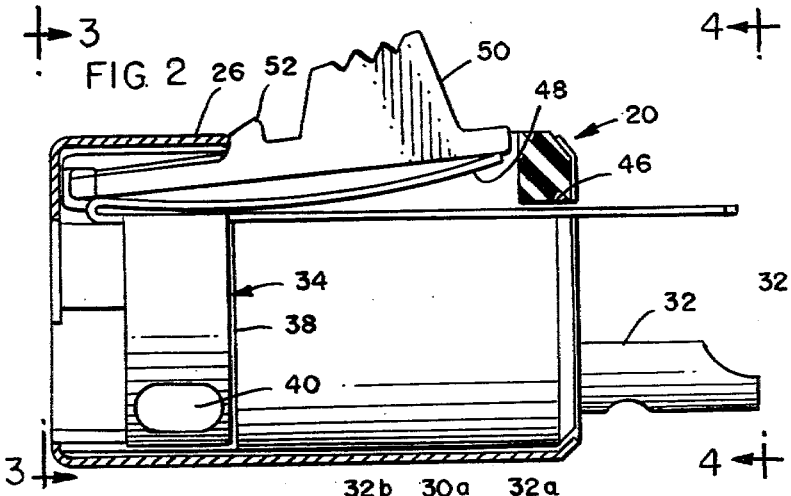
FIG. 4
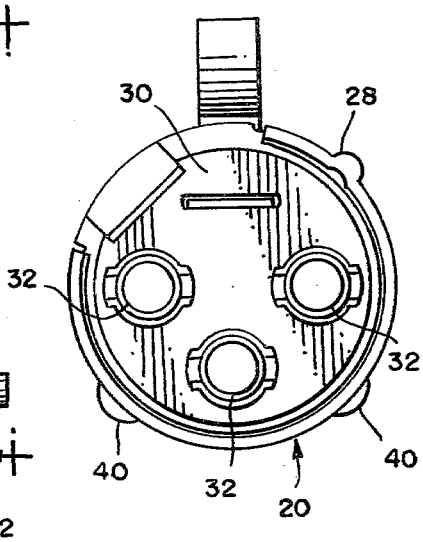
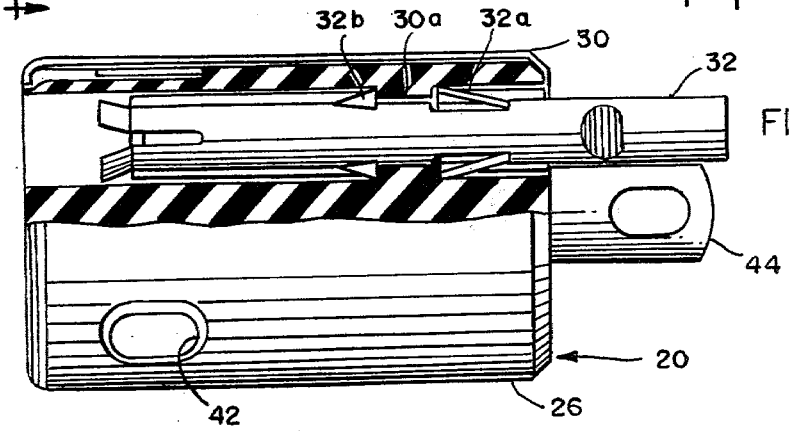
FIG. 5
FIG. 3
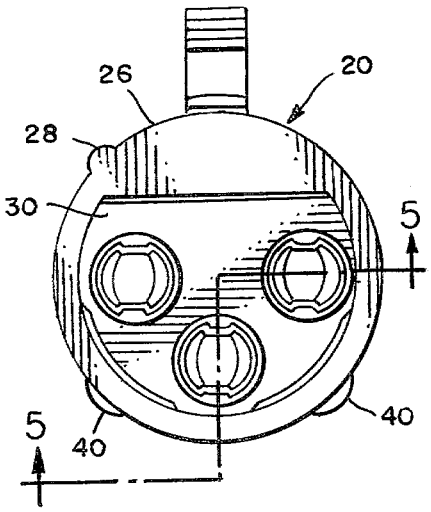
FIG. 6
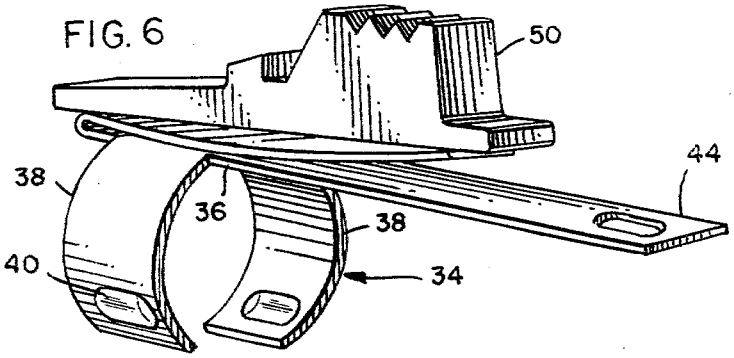

FIG. 7
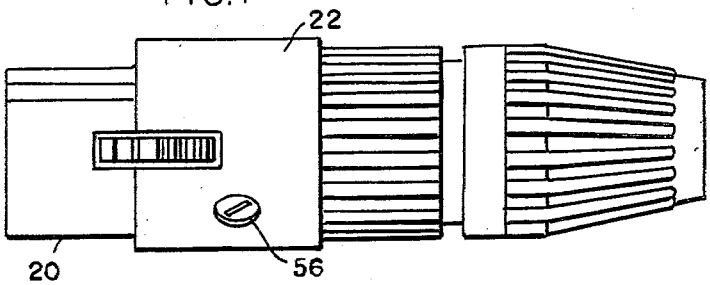
FIG. 8
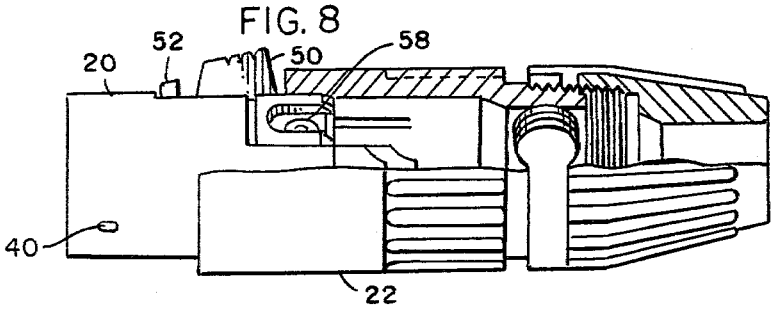
FIG. 9
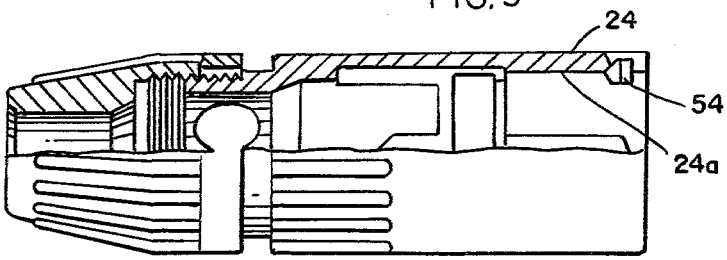
FIG. 9A
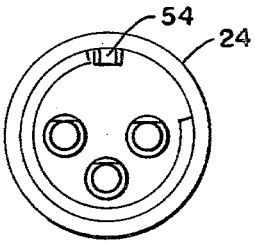
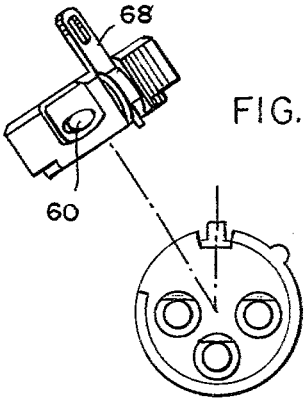
FIG. 11
FIG. 10
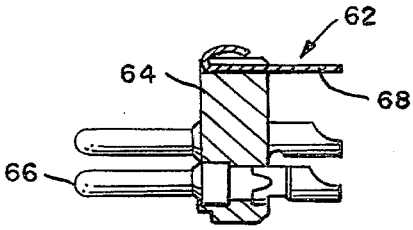
FIG. 12
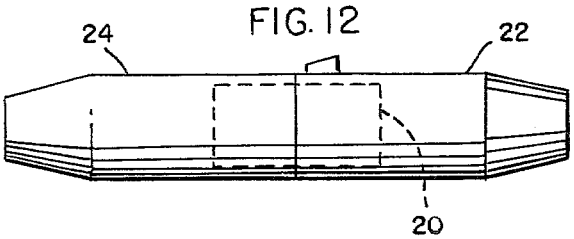

MICROPHONE CONNECTOR

BACKGROUND OF THE INVENTION

The present invention relates generally to electrical connection devices and more particularly to plug and socket connectors of the type used to couple cable conductors. Such a connector would be used for example in reversibly connecting a microphone cable to a cable for related equipment.

It is known in the prior art to employ cable connectors embodying interfitable, cooperating parts for purposes of electrically connecting cable conductors having a ground wire or sheath asociated therewith. The ground wires or sheaths may be in electrical connection with the respective housing portions of the connector in which each ground wire or sheath terminates whereby it is advantageous to electrically connect both portions of the connector housing together to provide a continuous grounding path through the connector. Such an electrical connector is generally disclosed in U.S. Pat. No. 3,219,961 to Bailey et al issued on Nov. 23, 1965.

It is known that a conductor sheath, for example, may be grounded at intervals to shield the conductor against impingement thereon of externally generated electrical interference. It is further known that the cable sheath, for the optimum performance of its function, should extend in an unbroken fashion throughout the entire length of the cable.

Accordingly, in utilizing such a connector as considered hereinabove, interference by electrical impulses emanating from sources outwardly of the connected cables may be minimized.

The connector disclosed in U.S. Pat. No. 3,219,961 includes means for connecting cable sheaths to the respectively associated metallic housing portions and in turn discloses means for electrically connecting the housing portions and necessarily the ground wires or sheaths to one another across the connection.

Although connectors are known to include both halves of their housings electrically connected to one another as well as the respective ground wires or sheaths related thereto, such connectors include a multiplicity of elements which in turn involves the disadvantages of complicated fabrication, assembly and sources of reliability problems.

SUMMARY OF THE INVENTION

Accordingly, one object of the present invention is to provide a cable plug connector assembly having a minimal number of components with both halves of the connector shell or housing being in electrical connection whereby the ground wire or sheath respectively connected to each half of the connector shell or housing are connected to one another.

Another object of the present invention is to provide a cable connector embodying cooperating parts preferably comprising prong and socket conductor terminals formed for interfitting engagement, in order to electrically connect cable conductors, such terminals being mounted in supporting bodies of insulation.

A further object of the present invention is to provide a grounding clip which is adapted to be mounted in a socket insert subassembly in the cable plug wherein the grounding clip functions to insure grounding of both connector housing halves to one another while also providing for electrical connection of at least one conductor ground wire means to the connector housing.

A still further object of the present invention is to provide the aforesaid grounding clip with an integral spring element which coacts with a latching means for the connector thereby eliminating the need for a separate latch actuating element.

In summary, the present invention provides a cable plug type connector operable to electrically connect both halves of the connector housing to one another as well as ground wires or sheaths respectively associated with and connected to each half of the connector housing. The cable plug assembly includes a plug shell for the mounting therein of a socket insert subassembly. The socket insert subassembly extends or projects beyond the plug shell through an open end therein and is axially restrained against relative movement with respect to the plug shell by a retention screw means threaded through the wall of the plug shell.

The socket insert subassembly in turn includes a socket shell and a socket insert of plastic or insulating material which carries contacts for connection with the cable conductors. The screw retention means in the plug shell urges the socket shell into electrical contact with the plug shell. A receptacle assembly includes a coupling cavity for mating with the projecting portion of the socket insert subassembly. A grounding clip comprises part of the socket insert subassembly and includes a medial portion mounted in a transverse slot in the socket insert and arms extending outwardly from the medial portion with a protuberance on the end of each arm for resilient projection through corresponding apertures in the socket shell. The protuberances engage the surface of the mounting cavity in the receptacle assembly housing and urge the socket insert against the socket shell whereby the latter is urged into electrical contact with the mounting cavity. In this manner, the plug shell and receptacle assembly housing are insured of being in electrical contact with one another. Should the connector be subjected to shock or vibration the resilient nature of the arms on which the protuberances are formed avoids uplift of the protuberances from contact with the receptacle housing.

In addition, the aforesaid grounding clip includes a grounding lug which extends into the plug shell for connection with a ground wire disposed therein. The ground wire is thereby electrically connected to the plug shell through the grounding clip, the receptacle assembly housing and the socket shell. The grounding clip further includes a cantilevered spring element extending from its medial portion. The spring element is disposed within the socket insert subassembly to resiliently bias a latching element in a disposition for locking the plug and receptacle assemblies together.

The foregoing and other objects, advantages and characterizing features of the present invention will become thoroughly apparent from the ensuing detailed description of the following embodiment thereof, taken together with the accompanying drawings wherein like reference characters denote like parts throughout the various views.

FIG. 1 is a top plan view of the socket insert subassembly with the grounding lug associated therewith projecting outwardly from the right hand end;

FIG. 2 is a longitudinal side view, partly in section, illustrating the socket insert subassembly of FIG. 1;

FIG. 3 is a left hand end view of the socket insert subassembly illustrated in FIG. 2;

FIG. 4 is a right hand end view of the socket insert subassembly illustrated in FIG. 2;

FIG. 5 is a bottom longitudinal view, partly in section, of the socket insert subassembly shown in FIG. 2, as taken about on line 5—5 of FIG. 3;

FIG. 6 is a perspective view of the grounding clip of the instant invention with a latching element supported on a spring element extending from the medial portion of the grounding clip;

FIG. 7 is a top plan view of the plug assembly of the instant invention comprising a socket insert subassembly mounted within a plug shell;

FIG. 8 is a longitudinal side view, partly in section, of the plug assembly shown in FIG. 7;

FIG. 9 is a longitudinal view, partly in section, of the receptacle assembly of the instant invention;

FIG. 9A is a right hand end view of the receptacle assembly shown in FIG. 9;

FIG. 10 is a detailed view of a pin insert for the receptacle assembly illustrated in FIG. 9;

FIG. 11 is a perspective view of the pin insert illustrated in FIG. 10; and

FIG. 12 is a longitudinal side view of the plug assembly illustrated in FIGS. 7 and 8 mated with the receptacle assembly illustrated in FIG. 9.

DETAILED DESCRIPTION OF A PREFERRED EMBODIMENT

Referring to the illustrative embodiment depicted in the drawings, there is shown generally in FIGS. 1, 2 and 5 a socket insert subassembly 20, the right hand end of which is adapted to be received in a plug shell 22 as illustrated in FIGS. 7 and 8. As viewed in FIGS. 7 and 8, the left hand end of subassembly 20 projects outwardly through the open end of shell 22 and is adapted to be received in a corresponding open end of the housing shell 24 of a receptacle assembly shown in FIG. 9. The subject matter of the instant invention is directed towards a construction whereby a ground wire associated with the plug assembly and electrically connected to shell 22 thereof is connected to a ground wire associated with the receptacle assembly in FIG. 9, the latter ground wire being connected to shell 24. The electrical connection of the ground wires one to the other is effected through the electrical connection of shells 22 and 24 one to the other, all of which will be described in detail hereinbelow.

Turning now to FIGS. 1 through 6, insert subassembly 20 includes an outer socket shell 26 having a longitudinally extending, radially projecting rib 28 which keys with aligned grooves in the plug shell and receptacle assembly housing. A socket insert 30 formed of a plastic insulating material carries contact means 32. Although three contacts are shown as being carried by the socket insert, a smaller or greater number of contacts could be employed as is well known to those skilled in the art. As is also well known, contact 32, as illustrated in FIG. 5, may be axially maintained in the socket insert by resilient tines 32*a* and shoulder means 32*b* which abut opposite end faces of the inwardly extending, annular shoulder 30*a* on the socket insert.

The insert subassembly further includes a grounding clip 34 which includes a medial portion 36 and resilient arms 38 which extend outwardly of the medial portion. Each arm includes or carries a protuberance 40 which, after assembly of the clip 34 in the insert subassembly, resiliently projects through a corresponding opening 42 in the socket shell. The grounding clip arms are configured to generally surround the insert 30 which may have corresponding depressions formed therein for seating of the arms since engagement of the socket shell over the arms tends to radially compress the same. The grounding clip further includes a grounding lug portion 44 which extends axially from the medial portion of clip 34 beyond that end of the insert subassembly which is received in plug shell 22. The medial portion of clip 34 and the portion of the grounding lug within the socket insert are mounted in a transverse slot 46 in the socket insert whereby upward movement imparted to the grounding clip is transmitted to the socket insert.

The grounding clip further includes a spring element 48, having a reverse bend extending from the medial portion of the clip to engage or coact with an overlying latching element 50. The left hand end of the latching element, as viewed in FIG. 2, pivots about the top of the reverse bend on the spring element whereby the right hand end of the latching element resiliently projects through a corresponding opening in the socket shell 26. As considered hereinbelow, the catch or protrusion 52 on the latch is resiliently received in a corresponding groove 54 in the receptacle assembly housing. Accordingly, the latch 50 may be selectively depressed to uncouple the combined plug shell/socket insert subassembly from the receptacle housing.

With respect to mounting of the socket insert subassembly in plug shell 22, a retention means therefor is provided in the form of a retaining screw 56 which is threaded radially through the plug shell for nesting in a corresponding cavity 58 in the socket insert. The retention screw 56 may be formed at its inner end so that it cannot be completely withdrawn from the plug shell to thereby avoid the possibility of its being lost during assembly/disassembly of the socket insert. In addition, the retention screw 56 functions to press the socket insert against the socket shell 20 whereby the latter is urged into electrical contact with the inner surface of the plug shell.

The receptacle assembly housing 24 defines a coupling cavity 24*a* which receives in sliding interfitment therewith the portion of the socket insert subassembly which projects beyond the plug shell 22. FIGS. 10 and 11 illustrate a pin insert for housing 24 which is mounted therein in a fixed axial position by means of a retaining screw, similar to 56, threaded through the wall of housing 24 to engage a corresponding cavity 60 in the pin insert 62. Insert 62 includes a plastic body 64 in which cavity 60 is formed, body 64 carrying contact means 66 corresponding in number to contact means 32. As is apparent from the drawings, the male portions of contact means 66 are oriented for engagement with the female portions of contact means 32. In addition, pin insert 62 includes a grounding lug element 68 to which a ground wire or sheath associated with the receptacle assembly may be connected. The upper portion of the ground lug 68 is provided with a reverse bend spring element for electrically contacting the inner surface of housing 24 when the insert 62 is in assembled position.

FIG. 12 illustrates a complete plug assembly comprising socket insert 20 and plug shell 22 latched to the receptacle assembly defined by housing 24. In the latched or mated condition illustrated in FIG. 12, the contact means 66 are electrically connected to the contact means 32 whereby respective cable conductors attached thereto are electrically connected one to the other. As considered hereinabove, it is a primary feature of the instant invention that ground wires or braids respectively associated with the receptacle assembly and plug assembly be in electrical contact with housing 24 and shell 22 and therefore in electrical connection with one another through the electrical connection of housing 24 to shell 22.

Upon insertion of the projecting portion of the socket insert subassembly 20 into the receptacle assembly, protuberances 40 are cammed inwardly and upwardly by the inner surface of housing 24. Since the medial portion of grounding clip 34 is mounted in a transverse slot in the socket insert, the latter is urged upwardly which in turn urges the socket shell 26 upwardly into affirmative electrical contact with the inner surface of housing 24. The protuberances are maintained in contact with housing 24 at all times, even when the connector experiences shock or vibration, due to the resilient biasing of arms 38 toward housing 24. As indicated above, the end portion of socket shell 26 within the plug shell 22 is in affirmative electrical contact therewith by the force exerted through the retention screw 56.

Accordingly, housing 24 is electrically connected to shell 22 through shell 26. In turn, a ground wire or braid attached to grounding lug 44 is electrically connected to plug shell 22 through the ground clip and protuberances 40, housing 24 and socket shell 26. A grounding wire or braid associated with lug 68 is directly connected to housing 24 which is of course in connection with the ground wire associated with grounding lug 44.

Variations of the above embodiment are available. For example, the grounding lug on clip 34 could be deleted with the ground wire or braid in the plug assembly being connected directly to plug shell 22 by, for example, a grounding lug similar to 68. In this situation, the operation of the grounding clip in urging the socket shell 26 into affirmative electrical contact with housing 24 would be affected, and the housing 24, shell 22 and their respective ground wire/braids would all be interconnected.

From the foregoing, it is apparent that the objects of the present invention have been fully accomplished. As a result of this invention, an improved electrical connector is provided for connecting the conductors of a cable to corresponding conductors of another cable wherein ground wires/sheaths respectively associated with the cables are interconnected to one another through the shells of the connector. In this regard, it is also within the scope of the present invention that the cable plug assembly described herein could be mated with a flange or panel receptacle assembly instead of the cable receptacle assembly illustrated. Of course, similar grounding considerations would be applicable.

Having thus described and illustrated a preferred embodiment of our invention, it will be understood that such description and illustration is by way of example only and that such modifications and changes as may suggest themselves to those skilled in the art are intended to fall within the scope of the present invention as limited only by the appended claims.

We claim:

1. An electrical connector including a plug assembly having a projecting portion, and a cooperating receptacle assembly having a housing defining a coupling cavity which receives said projecting portion in sliding interfitment therewith, said plug assembly having a plug shell with an open end and a socket insert subassembly mounted therein extending beyond said open end of said plug shell to form said projecting portion; said socket insert subassembly comprising a socket insert of insulating material carrying contact means, a socket shell enclosing said socket insert and being disposed within said coupling cavity of said receptacle assembly, said plug shell being in electrical contact, with said coupling cavity of said receptacle assembly and said plug shell and a grounding clip insuring electrical contact between the outer surface of said socket shell and the adjacent surface of said coupling cavity, said grounding clip having at least one protuberance projecting outwardly of said socket shell and engaging the surface of said coupling cavity to urge at least a portion of said socket shell into electrical contact with the adjacent surface of said coupling cavity whereby said receptacle assembly housing and said plug shell are electrically grounded to one another through said socket shell.

2. An electrical connector as set forth in claim 1 wherein said grounding clip includes a grounding lug adapted for electrical connection with a ground wire means associated with said connector whereby said ground wire means would be in electrical connection with said plug shell and said receptacle assembly housing when connected to said grounding lug.

3. An electrical connector as set forth in claim 2 wherein said grounding lug extends into said plug shell for connection with a ground wire means associated with said plug shell whereby said plug shell ground wire means would be in electrical connection with said plug shell through said grounding clip, said receptacle assembly housing and said socket shell.

4. An electrical connector as set forth in claim 3 wherein said receptacle assembly housing is adapted to be in electrical connection with a ground wire means associated with said receptacle assembly housing whereby ground wire means respectively associated with said plug shell and said receptacle assembly housing would be in electrical connection with one another.

5. An electrical connector as set forth in claim 1 including socket insert subassembly retention means, said retention means restraining said socket insert subassembly against axial movement with respect to said plug shell and urging at least a portion of said socket shell into electrical contact with said plug shell.

6. An electrical connector as set forth in claim 4 including socket insert subassembly retention means, said retention means restraining said socket insert subassembly against axial movement with respect to said plug shell and urging at least a portion of said socket shell into electrical contact with said plug shell.

7. An electrical connector as set forth in claim 6 wherein said retention means comprises a screw means threaded into said plug shell and extending inwardly of said plug shell to engage said socket insert subassembly.

8. An electrical connector as set forth in claim 1 wherein said grounding clip is disposed within said socket shell and said socket shell includes at least one opening through which said grounding clip protuberance projects.

9. An electrical connector as set forth in claim 8 wherein said grounding clip protuberance resiliently projects through said socket shell opening with said grounding clip engaging said socket insert to urge the same against said socket shell whereby the latter is urged into electrical contact with the surface of said coupling cavity.

10. An electrical connector as set forth in claim 9 wherein said grounding clip includes a medial portion and arms extending outwardly of said medial portion, each said arm carrying a protuberance projecting through a corresponding opening in said socket shell, and wherein said socket insert includes a transverse slot in which said medial portion of said grounding clip is mounted so that said medial portion urges said socket insert against said socket shell in reaction to the engagement of said protuberance against the surface of said coupling cavity.

11. An electrical connector as set forth in claim 9 wherein said grounding clip includes a grounding lug extending into said plug shell, said grounding lug being adapted for electrical connection with a ground wire means associated with said plug shell whereby said plug shell ground wire means would be in electrical connection with said plug shell through said grounding clip, said receptacle assembly housing and said socket shell.

12. An electrical connector as set forth in claim 11 including socket insert subassembly retention means, said retention means restraining said socket insert subassembly against axial movement with respect to said plug shell and urging at least a portion of said socket shell into electrical contact with said plug shell.

13. A socket insert subassembly adapted for connection with an electrical connector having a plug shell with an open end for reception and mounting of said socket insert subassembly therein whereby said socket insert subassembly would extend beyond said open end of said plug shell to form a projecting portion, said electrical connector further including a receptacle assembly having a housing defining a coupling cavity for cooperative mating with said plug shell and for receiving said projecting portion in sliding interfitment therewith, said socket insert subassembly comprising:

a socket insert of insulating material carrying contact means, a socket shell enclosing said socket insert and being adapted for disposition within said receptacle assembly coupling cavity and said plug shell in electrical contact therewith, and a grounding clip adapted to effect electrical contact between the outer surface of said socket shell and the adjacent surface of said coupling cavity when said socket shell is disposed therein, said grounding clip having at least one protuberance projecting outwardly of said socket shell and being adapted to engage the surface of said coupling cavity to urge at least a portion of said socket shell into electrical contact with the surface of said coupling cavity whereby said receptacle assembly housing and said plug shell would be electrically grounded to one another through said socket shell when assembled therewith.

14. A socket insert subassembly as set forth in claim 13 wherein said grounding clip includes a grounding lug adapted for electrical connection with a ground wire means associated with said plug shell and said receptacle assembly housing whereby said ground wire means would be in electrical connection with said plug shell and said receptacle assembly housing when connected to said grounding lug.

15. A socket insert subassembly as set forth in claim 14 wherein said grounding clip is disposed within said socket shell and said socket shell includes openings therethrough, said grounding clip including a medial portion and arms extending outwardly of said medial portion with each said arm carrying a protuberance projecting through a corresponding opening in said socket shell, and wherein said socket insert includes a transverse slot in which said medial portion urges said socket insert against said socket shell in reaction to the engagement of said protuberances against the surface of said coupling cavity when engaged therein whereby said socket shell would be urged into electrical contact with the surface of said coupling cavity.

16. An electrical connector as set forth in claim 12 wherein said grounding clip includes a spring element affixed to said medial portion, and said plug assembly includes a latching element for mating with said receptacle assembly, said spring element coacting with said latching element to bias the same into a locked disposition with said receptacle assembly.

17. A grounding clip adapted for mounting in a socket insert subassembly having a socket insert disposed within a socket shell, said socket shell having openings therein for interaction with said grounding clip and said socket insert including a transverse slot adapted for mounting of said grounding clip, said grounding clip comprising:

a medial portion and arms extending outwardly of said medial portion, each said arm carrying a protuberance adapted to project through a corresponding opening in said socket shell and said medial portion being adapted for mounting in said transverse slot so that said medial portion would urge said socket insert against said socket shell in reaction to inward movement of said protuberances with respect to said socket shell when mounted therein.

18. A grounding clip as set forth in claim 17 including a grounding lug adapted for electrical connection with a ground wire means.

19. An electrical connector means including a male portion, a cooperating female portion which receives at least a portion of said male portion in sliding interfitment therewith, and a housing means for housing at least a portion of said male portion and being in electrical connection therewith, said housing means having an open end beyond which said male portion extends for reception in said female portion; and said male portion comprising a socket insert means of insulating material carrying contact means, a socket shell means enclosing said socket insert means and being disposed within said female portion and being in electrical connection therewith, and a grounding clip means insuring electrical contact between the outer surface of said socket shell means and the adjacent surface of said female portion whereby said female portion and said housing means for said male portion are electrically grounded to one another through said socket shell means.

20. A socket insert subassembly means adapted for connection with an electrical connector means having a housing means with an open end for reception and mounting of a socket insert means, said socket insert means including a male portion extending beyond said open end of said housing means, and the electrical connector means further including a female portion for cooperative mating with said housing means and for receiving said male portion in sliding interfitment therewith, said socket insert means comprising:

an insert means of insulating material carrying contact means, a socket shell enclosing said insert means and being adapted for disposition within said housing means in electrical connection therewith and for disposition within said female portion in electrical contact therewith, and a grounding clip adapted to effect electrical contact between the outer surface of said socket shell and the adjacent surface of said female portion when said socket shell is disposed therein, said grounding clip having at least one means projecting outwardly of said socket shell and being adapted to engage the surface of said female portion to urge at least a portion of said socket shell into electrical contact with the surface of said female portion whereby said female portion and said housing means would be electrically grounded to one another through said socket shell when assembled therewith.

* * * * *